US008080292B2

(12) United States Patent
Zeng

(10) Patent No.: US 8,080,292 B2
(45) Date of Patent: Dec. 20, 2011

(54) COATED PAPER FOR PIGMENT-BASED INKJET PRINTERS

(75) Inventor: Xi Zeng, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 649 days.

(21) Appl. No.: 12/251,953

(22) Filed: Oct. 15, 2008

(65) Prior Publication Data

US 2010/0092678 A1 Apr. 15, 2010

(51) Int. Cl.
*B41M 5/00* (2006.01)

(52) U.S. Cl. ..... 428/32.21; 428/32.28; 428/32.34; 428/32.35

(58) Field of Classification Search ..... 428/32.21, 428/32.28, 32.34, 32.35
See application file for complete search history.

(56) References Cited

U.S. PATENT DOCUMENTS 5,120,365 A 6/1992 Kogler
5,232,495 A 8/1993 Shurling, Jr. et al.
5,833,747 A 11/1998 Bleakley et al.
5,879,442 A * 3/1999 Nishiguchi et al. ..... 106/464
5,882,396 A 3/1999 Hiorns
6,074,474 A * 6/2000 Broome et al. ..... 106/486
6,197,155 B1 3/2001 Wurster et al.
6,284,034 B1 9/2001 Hiorns et al.
6,423,181 B1 7/2002 Mendez-Gallon et al.
6,440,209 B1 8/2002 Ravishankar et al.
6,478,865 B1 11/2002 Malla et al.
2005/0119391 A1 6/2005 Mason et al.
2005/0260428 A1 11/2005 Song et al.
2006/0292305 A1 12/2006 Skuse et al.
2007/0134450 A1 6/2007 Campbell et al.
2007/0202279 A1 8/2007 Schultz et al.

* cited by examiner

*Primary Examiner* — Betelhem Shewareged

(57) ABSTRACT

A print medium is disclosed which includes a base paper containing a first side and a reverse side, and a coating layer disposed on at least the first side. The coating layer contains a mixture that includes about 10-90 weight percent of a first pigment comprising precipitated calcium carbonate particles, about 5-60 weight percent of a second pigment comprising particles of a liquid absorptive material having a larger size than the first pigment particles and having a different shape that of the first pigment particles, and about 1-50 weight percent of a third pigment comprising particles of a liquid absorptive high surface area material having a surface area of at least 50 $m^2$/gram, and having a smaller size that both of the first and second pigments. Weight percents are by combined weight of the first, second and third pigments.

18 Claims, 4 Drawing Sheets

COATED PAPER FOR PIGMENT-BASED INKJET PRINTERS

TECHNICAL FIELD

The present invention generally relates to inkjet printing technology, and more particularly to inkjet printing of pigment-based inks on specialty media to enhance image permanence.

BACKGROUND

In recent years, one of the trends in inkjet technology is that colorants in inkjet inks have advanced from dye molecules to pigment particles. Compared to dye-based ink, pigment-based colorants provided much better image permanence. For example, light-fade or ozone fade of an image printed with pigment-based inks is much slower than that of an image printed with dye-based inks. At the same time, water resistance is also significantly improved because dye molecules are more readily dissolved into water than are pigment particles. Therefore, dye-based images are easily damaged by water splashing, rain, or water droplets.

Some challenges exist with respect to pigmented inks, however. When pigment based inks are printed on traditional glossy coated specialty media such as glossy brochure paper or photo papers, some image quality and durability problems are encountered. In addition to the common image defects like feathering and coalescence, another common defect is print mottle. Mottling often presents as uneven random color patterns in a large area of an image. It is generally believed that uneven absorption of ink vehicle in the coating layer causes this defect, a result of uneven coat weight/thickness on base paper, and/or variation of pore structure in the coating layer. For coated paper, the underneath base paper is usually rougher than the final sheets. During a typical coating process, the thickness of the coating layer may vary with any bumps and valleys on the base paper surface. For media products produced with blade or air knife or similar technology, the coat weight variation could be appreciable, depending to a great extent on the surface roughness of the base paper. Even with precise coating methods such as curtain coating, in which the coat weigh uniformity is less dependent upon the topography of the base paper, there is often uneven coating thickness across the web. Since the absorption of liquid in coating layer is different than absorption in the base paper, variation of the coat weight is a major cause of print mottle. On another hand, coated paper usually goes through a calender or super calender step after the coating process in order to produce high glossy products. Under pressure and/or high temperature, the pores in the coating layer will deform. Due to uneven base paper and variation of coating thickness, calendering can easily cause differences in pore structure, i.e., patterns of pore size distribution and pore shape. Such differences will in many cases cause variation of ink penetration rate in the coating layer, and eventually exacerbate a print mottle defect.

In addition to print mottle defects, image permanence is another major challenge associated with the use of pigment-based inkjet inks on glossy coated media. After printing, wet pigment-based inkjet images on printed sheets are generally susceptible to smearing under any one of a number of conditions, such as rubbing with dry or wet fingers, rubbing with other printed or blank sheets, and marking with high-lighter pen. High-lighter smear is a major concern, especially on glossy media, where there are no small pores or recesses on a smooth surface for pigments to anchor. If pigment adhesion to the media surface is not sufficiently strong, ink particles are easily smeared with the rubbing of a high-lighter fluid. Hence, a matte media with the same coating tends to give better high-lighter smear resistance than a glossy product.

With recent advances in technology, inkjet technology has broadened its application to commercial and industrial printing, in addition to home and office usage. Following this trend, high-speed printing is required to support many new applications for inkjet technology. Glossy or matte porous specialty media are some of the choices in the media portfolio for these new high-speed inkjet printing applications. Traditional inkjet specialty media tend to be unsatisfactory for use with the new high-speed printers. In part, this is because of the large amount of relatively expensive small particle size materials, such as fumed silica, silica gel, fumed or colloidal alumina, boehmite, or mixtures of those, which are customarily used in the media in order to obtain good image quality and print quality. Although some available inkjet specialty media containing those materials may give excellent image quality and image permanence, their complicated manufacturing requirements and relatively high cost make the new high-speed inkjet printing systems noncompetitive with existing analogue printing methods and laserjet technology.

SUMMARY

In accordance with certain embodiments of the invention, a coated inkjet specialty media is provided to support pigment-based inkjet technology and overcome at least some of the challenges associated with many other inkjet print media. Certain embodiments of the invention provide a print medium, comprising: a base paper comprising a first side and a reverse side; and a coating layer disposed on at least said first side. The coating layer contains a mixture comprising (a) about 10 to about 90 weight percent of a first pigment comprising precipitated calcium carbonate particles, (b) about 5 to about 60 weight percent of a second pigment comprising particles of a liquid absorptive material having a larger size than the first pigment particles and a different shape that of the first pigment particles, and (c) about 1 to about 50 weight percent of a third pigment comprising particles of a liquid absorptive high surface area material having a surface area of at least 50 $m^2$/gram, wherein the weight percentages are by combined weight of the first, second and third pigments.

In accordance with another embodiment of the invention, a method of enhancing image quality and permanence of an inkjet printed image is provided which comprises obtaining the above-described print medium; inkjetting a pigmented ink onto the coating layer of the print medium, to form a printed image; and drying the printed image, to provide a printed medium with enhanced image quality and enhanced image permanence. Potential advantages offered by various embodiments of the invention include enhanced image quality and print quality, enhanced image permanence, and more cost effective manufacturing.

BRIEF DESCRIPTION OF THE DRAWINGS

For a detailed description of exemplary embodiments of the invention, reference will now be made to the accompanying drawings. The drawings are not necessarily drawn to scale.

NOTATION AND NOMENCLATURE

Figure 1:
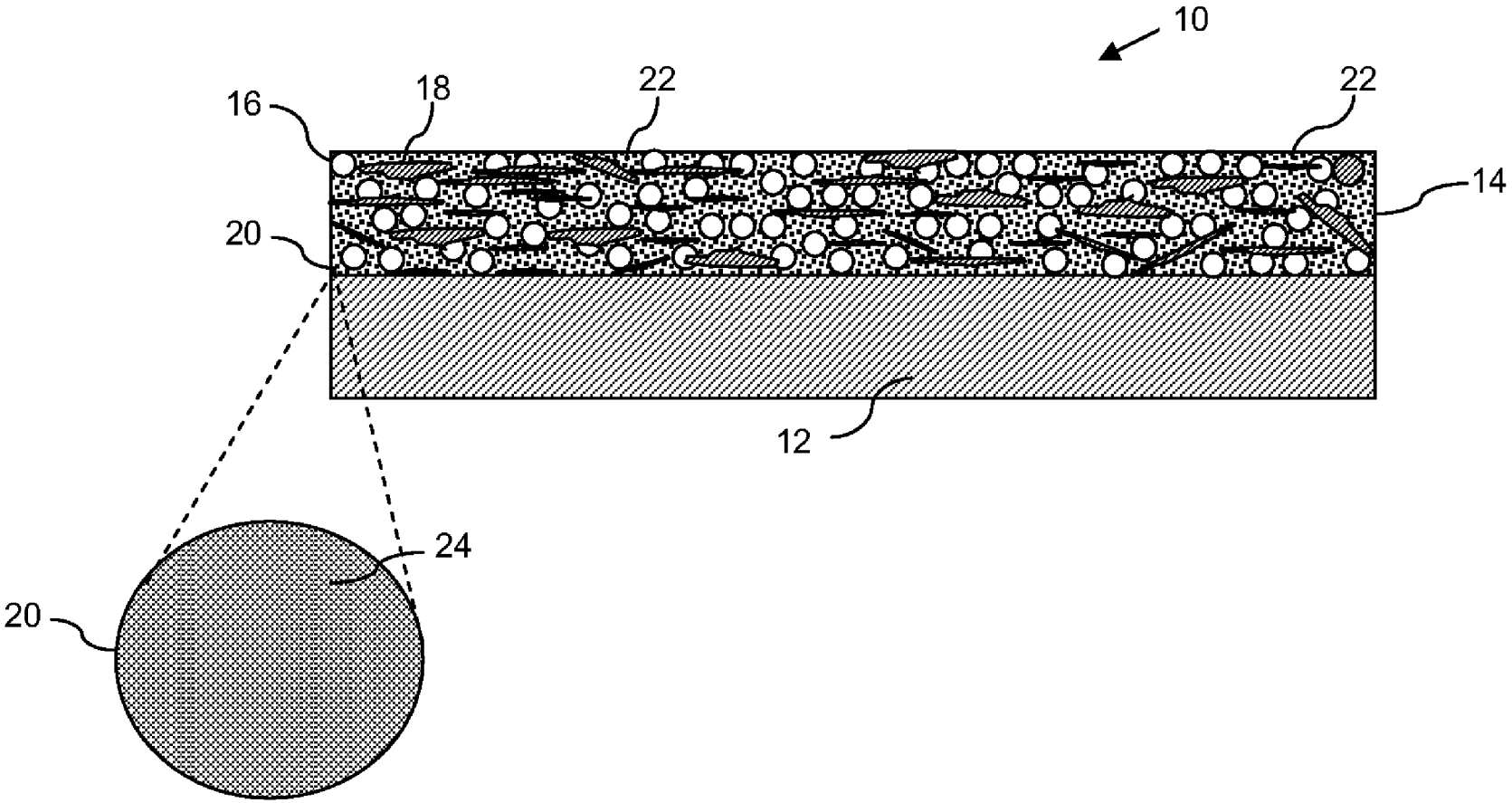
FIG. 1 is a schematic illustration of a coated print medium in accordance with an embodiment of the invention.

Certain terms are used throughout the following description and claims to refer to particular system components. As one skilled in the art will appreciate, those of skill in the art may refer to a component by different names. This document does not intend to distinguish between components that differ in name but not function. In the following discussion and in the claims, the terms "including" and "comprising" are used in an open-ended fashion, and thus should be interpreted to mean "including, but not limited to . . . . "

It should be noted that ratios, concentrations, amounts, and other numerical data may be expressed herein in a range format. It is to be understood that such a range format is used for convenience and brevity, and thus, should be interpreted in a flexible manner to include not only the numerical values explicitly recited as the limits of the range, but also to include all the individual numerical values or sub-ranges encompassed within that range as if each numerical value and sub-range is explicitly recited. To illustrate, a weight percentage range of "about 10 to about 90 weight percent" should be interpreted to include not only the explicitly recited concentration of about 10 to about 90 wt %, but also include individual concentrations (e.g., 12%, 20%, 30%, 40% . . . ) and also sub-ranges (e.g., 25-75 wt %, 40-46 wt % and the like) within the indicated range.

As used herein, the term "about" or "approximately," when preceding a numerical value, has its usual meaning and also includes the range of normal measurement variations that is customary with laboratory instruments that are commonly used in this field of endeavor (e.g., weight, temperature or pressure measuring devices), preferably within ±10% of the stated numerical value.

DETAILED DESCRIPTION

The following discussion is directed to various embodiments of the invention. Although one or more of these embodiments may be preferred, the embodiments disclosed should not be interpreted, or otherwise used, as limiting the scope of the disclosure, including the claims. In addition, one skilled in the art will understand that the following description has broad application, and the discussion of any embodiment is meant only to be exemplary of that embodiment, and not intended to intimate that the scope of the disclosure, including the claims, is limited to that embodiment.

There have been attempts to use lower cost, more readily available materials, such as calcium carbonate, kaolin clays, and other materials, in the manufacture of inkjet specialty media. Calcium carbonate is a common pigment in the paper coating industry, and is generally divided into two categories: precipitated calcium carbonate (PCC) and ground calcium carbonate (GCC). Both PCC and GCC enhance whiteness in paper coatings. While coated papers based on PCC potentially give faster ink absorption and more uniform penetration, to potentially reduce the possibility of print mottle, it has proven difficult to satisfy all of the requirements of the current inkjet technology with PCC and GCC-based paper coatings. For instance, it is often found that coated paper based on combinations of pigments of different types, and different sizes, size distributions, shapes, surface areas, and pore sizes or pore volumes give unexpected, non-uniform performance, especially with respect to ink absorption and print mottle. There is continued interest in providing coated inkjet print media that are capable of providing enhanced image quality and image permanence with pigment-based inks, especially in high-speed inkjet printing systems.

A new approach to addressing the above-mentioned challenges of high-speed inkjet printing on specialty media includes the preparation and use of a new coating formulation for double-side coated paper products, with a glossy, satin, or matte surface finish. When used for inkjet printer with pigment based inks, for example HP 8000 series MFP with Edgeline technology, embodiments of the coated media provide good image quality with little print mottles and improved durability performance, especially resistance to high-lighter smear. At the same time, many embodiments of the coated media have lower coating materials cost and greater ease of manufacture and operation, compared to most traditional analogue printing or laserjet technologies.

Referring to FIG. 1, an embodiment of a coated print medium 10 (sometimes also referred to herein as a coated paper) is schematically shown. The print medium 10 has a base paper or substrate 12 with an ink-receiving coating layer 14 on top. The coating layer 14 contains a combination of three different types of pigments, including first pigment particles 16 (e.g., precipitated calcium carbonate particles, "PCC"), second pigment particles 18 (e.g., platy clay), and a third pigment 20 with high surface area (e.g., fumed silica). In some embodiments, the coating layer contains this pigment combination comprising about 10-90 wt % of the first pigment, about 5-60 wt % of the second pigment, and about 1-50 wt % of the third pigment. In certain embodiments, the first pigment makes up about 25-75 wt %, and in some cases is about 40-65 wt % of the total pigments. In certain embodiments, the second pigment makes up about 5-40 wt % of the pigment composition, and in some cases is about 10-35 wt % of the total pigments. In some embodiments, the third pigment makes up about 5-35 wt %, and in certain instances is about 10-25 wt % of the total combined pigments in the coating layer.

The coating layer 14 also contains other components such as surfactants, binders, rheology modifiers, defoamers, optical brighteners, dyes, pH controlling agents, and other necessary components from which the coating layer is formed on substrate 12. The coating formulation and the method of making the print medium are described in more detail below.

Figure 2:
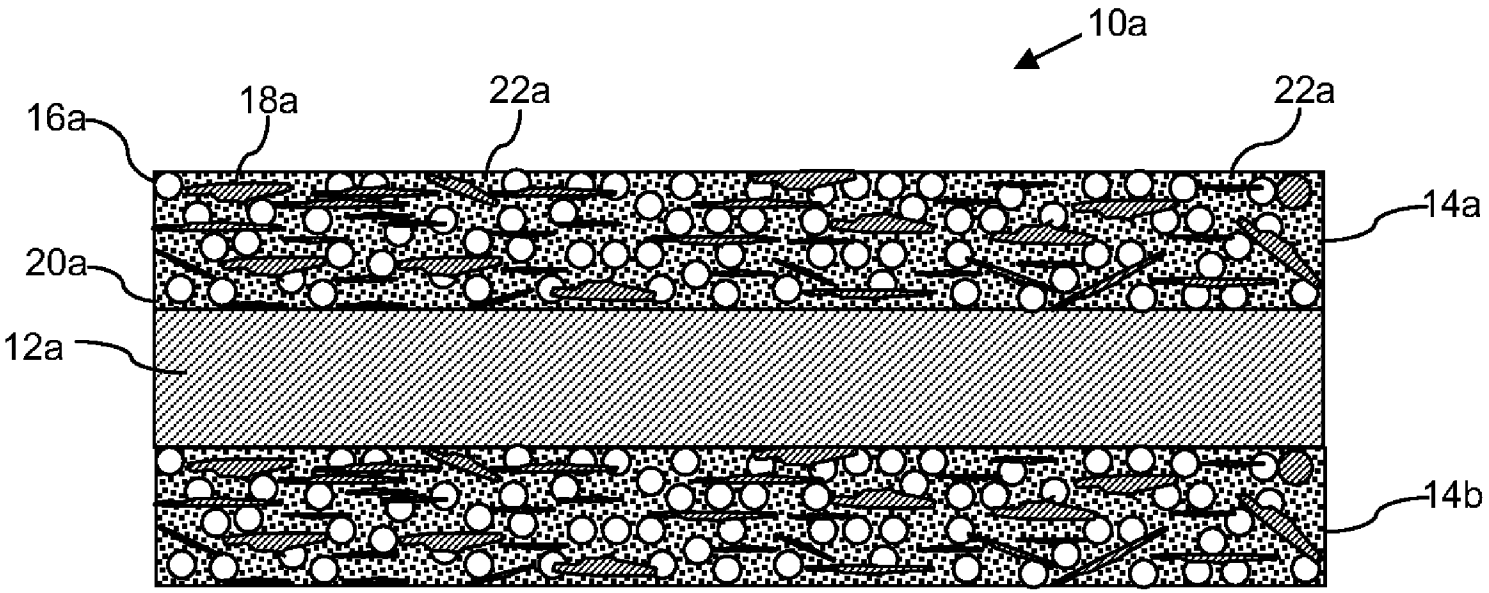
FIG. 2 is a schematic illustration of a coated print medium in accordance with another embodiment of the invention.

FIG. 2 is a schematic illustration of another embodiment of a coated print medium like that of FIG. 1, except that print medium 10*a* has a "sandwich" structure, in which both sides of the base paper or substrate 12 are coated with the same coating layer 14*a*, 14*b*. Each coating layer 14*a*,14*b* contains PCC particles 16*a*, second pigment 18*a*, and third pigment 20*a*, with voids 22*a* between particles. In many applications it is advantageous to the user for the print medium to be the same on both sides, for ease of use.

First Pigment.

Figure 4:
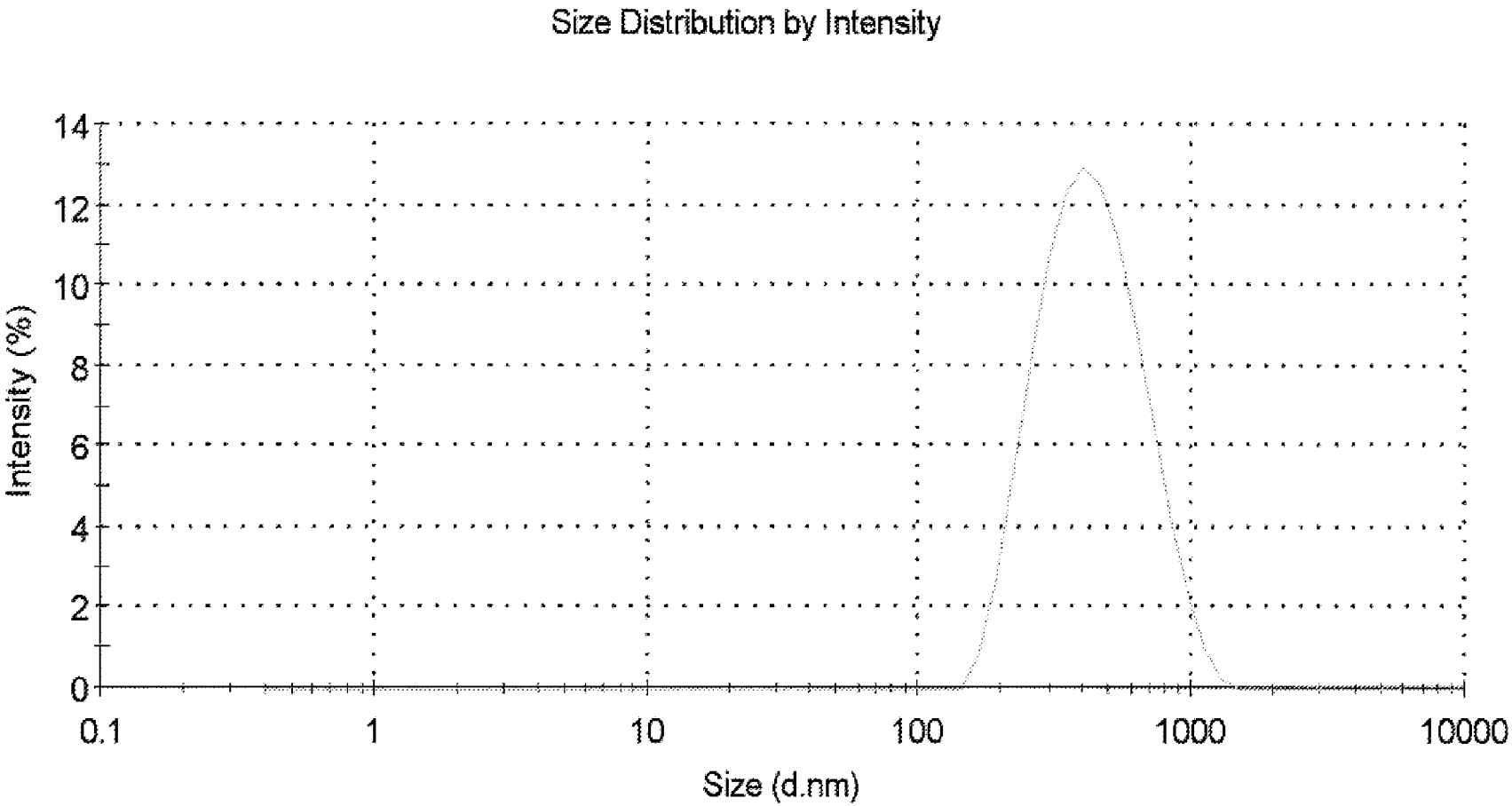
FIG. 4 is a graph showing the particle size distribution curve of a representative PCC pigment, Opacarb A40™, as used in an embodiment of the coating layer of FIG. 1.

In the coated paper illustrated in FIG. 1, the major pigment in the coating layer 14 is precipitated calcium carbonate (PCC) particles with narrow size-distribution. Since a smaller size particle generally gives high liquid absorption rate, a narrow size-distributed PCC particle with small particle size is preferred in the coating layer. For example, a PCC particle with average particle size less than 1 micron, preferably about 400 nm or even smaller is contained in coating layer 14. FIG. 4 illustrates particle size distribution curve of a PCC pigment, Opacarb A40™, from Specialty Minerals Inc. Suitable preparations of PCC particles are commercially available from well known suppliers. Alternatively, PCC particles in the specified size ranges may be prepared in accordance with known methods that are described in the literature. For example, Chapter 2, in "The Coating Processes" edited by J. C. Walter, Tappi Press, Atlanta, Ga., 1993) describes one such method.

Second Pigment.

A coated paper with only PCC particles in the coating layer would have only limited capacity for inks. This is mainly due to the fact that PCC particles tend to form a very dense packing structure in the coating layer because of its uniform particle size and shape and narrow size distribution. Hence, the present combinations of PCC particles 16 and a second pigment 18 having a larger particle size generate many pores of greater size than with PCC particles alone. The combination of defined particle sizes potentially improves the capacity of coating layer 14, especially when the second pigment 18 has different shape and particle size, compared to the PCC particles. Without wishing to be limited to any theory, it is believed that inclusion of the second pigment disrupts the packing structure of PCC particles in coating layer 14, creating voids 22 between particles that enhance the flow and storage of liquid. The second pigment 18 is a GCC pigment, or clay pigment such as kaolin clay, hydrated clay, calcined clay, or other material that is capable of functioning in a similar manner. Preferably the second pigment has a larger particle size and a different shape than the PCC pigment. Since it is easier to control the size, size distribution, and shape of PCC particles during manufacturing processes, compared to GCC particle manufacturing processes, the size distribution range of GCC particles is not necessarily as narrow as that of the first pigment particles. In some embodiments, the average particle size of the second pigment is in the range of about 0.5-10 microns. In certain instances, the second pigment's size is in the range of about 0.5-5 microns, and in some cases is about 0.8 to 2 microns in size. In some embodiments, the size distribution of the second particles is as narrow as that of the PCC particles, and in some other embodiments the distribution of sizes of the second particles is broader than that of the PCC particles. Suitable preparations of GCC, or platey clay particles, are commercially available from well known suppliers. Alternatively, GCC and platey clay particles in the specified size ranges may be prepared in accordance with known methods that are described in the literature. For example, as described in Chapter 2, in "The Coating Processes" edited by J. C. Walter, Tappi Press, Atlanta, Ga., 1993).

Since calcium carbonate has comparatively poorer water retention properties, in many cases it is desirable to use a clay pigment as the second pigment 18, especially a clay pigment with a high aspect ratio, sometimes referred to as "platey clay." Platey clays have a planar shape, with dimensions ranging from submicron up to several microns, or even up to more than 10 microns. The thickness is usually much smaller than its dimension, however. The aspect ratio of dimension to thickness may be in the range of 5-100, or even greater. Platy clays provide high capacity and better liquid absorption rates than calcium carbonate. Another feature of platy clays as the second pigment 18 is that they potentially improve the sheet gloss and help to produce a gloss product. In some embodiments, the second pigment is a combination of GCC particles and platey clay. For example, in some embodiments the weight ratio between GCC particles and platey clay is in range from 1:5 to 5:1. In coating formulations, total composition of second pigments may be in the range of about 5-60 wt %. In some instances, the concentration of second pigments are in the range of about 5-40 wt %, and in still other instances, the concentrations are in the range of about 10-35 wt %.

Third Pigment.

To even further improve liquid penetration in the coated medium 10, especially when it is intended for use in an inkjet digital printing application, a third pigment 20 is also included in coating layer 14. The third pigment has a higher surface area than the first and second pigments, preferably 50 $m^2$ per gram or higher. As illustrated in the expanded view of pigment particle 20 shown in FIG. 1, third pigment particle 20 has a porous secondary structure 24 comprising many small pores and big pore volume. Suitable materials for the third pigment particles include, but are not limited to, fumed silica, silica gel, colloidal silica, zeolite, alumina, although any another suitable material capable of functioning similarly to those materials could be used. For example, recently discovered materials with nano-meter scale structure, such as the engineered calcium carbonate OmyaJet® (Omya Corporation, Alpharetta, Ga.) may serve as the third pigment in some instances. OmyaJet® is a specialty ground calcium carbonate pigment. Its surface has been through special treatment to increase surface area and liquid absorption rate, to a high BET surface area of about 50 $m^2/g$ . In addition to improving liquid absorption, inclusion of a suitable third pigment is also potentially beneficial with respect to other properties of coated paper 10. In representative tests, it was found that silica in the coating layer, as a third pigment, improves rub resistance and reduces high-lighter smear of printed sheets. In some embodiments, a typical composition of silica in the coating layer is in the range of 1-50 wt %. In some embodiments, it makes up about 5-35 wt % of the coating layer, and in certain cases is about 10-25 wt % of the coating layer. A potential advantage of using a coated medium containing the defined three pigment-based coating layer is that much less silica is required in order to demonstrate enhanced rub resistance and high-lighter smear resistance, compared to existing silica-based coated media.

Manufacture of Coated Media

In addition to the above-described three pigments, the coating formulations used to make the coated media also contain other components, as necessary, to carry out the required mixing, coating, manufacturing, and other process steps, as well as to satisfy other requirements of the finished product, depending on its intended use. These additional components may include various binders, surfactants, defoamers, rheology modifiers, and any other necessary additives, as may be customarily used for making coated inkjet print media.

Referring to FIG. 1, the coating layer 14 is applied using any of a variety of suitable coating methods, like blade coating, air knife coating, metering rod coating, curtain coating, or another suitable technique. These techniques are all known in the art. For a C1S product, which is a chromo-type paper containing a woodpulp or woodfree stock, and typically used for making labels, wrappings and cover paper, only one side of the substrate material is coated. For a C2S product, which includes art printing papers made from a premium-grade stock and typically used for the high-quality reproduction of color prints, both sides of substrate are coated. For a C2S product, depending on set-up of production machine in a mill, both sides of the substrate may be coated during a single manufacture pass, or each side is coated in a separate pass. After the coating step, the product then goes through a drying process to remove water and other volatile components in the coating layer and substrate. The drying pass may comprise several different drying zones, including, but not limited to, infrared (IR) dryers, hot surface rolls, and hot air floatation boxes. Depending upon the intended application, the coated paper may keep the matte surface without a further calendering step, or it may receive a glossy or satin surface with a calendering or super calendering step. When a calendering step needed, the coated product passes an on-line or off-line calender machine, which could be a soft-nip calender or a supercalender. The rolls in a calender machine may or may not be heated, and certain pressure is usually applied to calendering rolls. Calendering techniques and apparatus are generally known in the art. The materials manufacturing costs of the print media as illustrated in FIGS. 1 and 2 are potentially much lower than traditional inkjet media, and in embodiments are in the same range as conventional offset and laserjet specialty papers.

The following are examples of coating formulations containing the specified three pigment combinations. Comparative examples are also provided.

EXAMPLE 1

First Pigment:
Opacarb™ A40 (Specialty Minerals Inc.): 60 parts
Second Pigment:
Hydramatte™ (J. M. Huber Corporation): 15 parts
Third Pigment:
Silica dispersion A25 (Grace Davison): 25 parts
Binder:
Rovene™ 4040 (Mallard Creek Polymers, Inc.): 11 parts
Co-binder:
Mowiol™ 20-98 (Kuraray America, Inc.): 0.5 parts
Surfactant:
Tego Wet™ 510 (Evonik Industries): 0.7 parts Hydramatte® (J. M. Huber Corporation, Locust, N.J.) is a kaolin clay based pigment used in the manufacture of paper and paper related products. Opacarb™A40 (Specialty Minerals Inc., New York, N.Y.) is precipitated calcium carbonates (PCCs) of aragonite morphology, having an average particle size of 0.4 mm and a BET surface area of 12 $m^2/g$. Silica dispersion A25 (Grace Davison, Colombia, Md.) is an aqueous silica gel dispersion, having an average particle size of around 350 nm and a BET surface area about 200 $m^2/g$. Rovene™ 4040 (Mallard Creek Polymers, Inc., Charlotte, N.C.) is a nonionic non-carboxylated styrene-butadiene latex emulsion. Mowiol™ 20-98 (Clariant Corporation, Charlotte, N.C.) is a polyvinyl alcohol product, having a hydrolysis degree of about 98.4+/−0.4%, and viscosity of 20+/−1.5 cps at 4% solution in water. Tego Wet™ 510 (Evonik Industries, Irvine, Calif.) is a silicone-free nonionic surfactant, having good substrate wetting capability and good ability to reduce dynamic surface tension. All the ingredients are mixed together in a beaker and kept stirring overnight by using a normal bench stirring equipment. This formulation was coated on a base paper stock with coat weight of 20 gram per square meter (gsm). The base paper is a regular B size (11"× 17") sheet with basis weight of 90 gsm, and some typical manufacturer of this kind of paper includes Domtar, Stora Enso, and International Paper. The coated samples were then dried by a normal heat gun. After drying, the coated paper was then calendered one pass at a lab calender machine under pressure of 3200 psi, at 130° F. temperature. The final sheets gave a gloss level of 70% at 75°, by using a "Micro gloss 75°" glossimeter from BYK-Gardner. The sample was printed on a HP 8060 MFP with Edgeline technology (Hewlett-Packard Corporation). During testing process, it used standard inks for this printer, i.e., HP C8750A black ink, HP C8751A cyan ink, HP C8752A magenta ink, HP C8753A yellow ink, and HP C8754A bonding agent ink. The total image quality was very good, no obvious bleeding, coalescence or print mottles. The measured gamut was 387K, and black optical density (KOD) was 2.22. The printed sheet was then tested with a Faber-Castell high-lighter, at 5 minute and 24 hours after printing. Table 1 includes the measured ink transfer amount from printed area to adjacent blank sheet under high-lighter smear with one pass and two passes. The higher number means more ink is smeared off by the high-lighter, i.e., worse durability. Table 1 also includes data of sheet gloss, gamut and KOD.

EXAMPLE 2

First Pigment:
Opacarb™A40: 55 parts
Second Pigment:
Ansilex™ 93 (BASF): 25 parts
Third Pigment:
OmyaJet™ C4440 (OMYA): 20 parts
Binder:
Rovene™ 4040 (Mallard Creek Polymers, Inc.): 11 parts
Co-binder:
Mowiol™ 20-98 (Kuraray America, Inc.): 1 parts
Surfactant:
Tego Wet™ 510 (Evonik Industries): 0.7 parts Ansilex™ 93 (BASF, Florham Park, N.J.), is a high-brightness, low-abrasion pigment for improving brightness, opacity, blister resistance and ink receptivity without the loss of sheet or print gloss. The coating and calendering condition for this three-pigment formulation is the same as in Example 1. The final sheets give a gloss level of 65% at 75°. The sample was also printed on a HP 8060 MFP with Edgeline technology. The total image quality is very good, with no obvious bleeding, coalescence, and print mottle. The measured gamut was 427K, and KOD was 2.32. The printed sheet was also tested with a Faber-Castell high-lighter, as the same procedure in Example 1, and the data is listed in Table 1.

COMPARATIVE EXAMPLE A (INKJET MEDIA)

As a comparison, below also list some coating formulation for traditional inkjet and offset media, as well as their testing results.

Orisil™ 200: 100 parts
Olin™ 10 G: 0.3 parts
Mowiol™ 40-88: 13 parts
Boric acid: 0.28 parts
Glycerin: 1 parts Orisil™ 200 (Orisil Ltd, Lviv, Ukraine) is amorphous fumed silica produced by vapor phase hydrolysis of silicon tetrachloride in a flame of hydrogen and oxygen, having a BET surface area of 200+/−25 $m^2/g$. Olin™ 10 G, a wetting agent, is p-isononylphenoxypoly(glycidol), also known as Olin-10 G or Surfactant 10-G (commercially available as 10 G from Olin Chemicals, Charleston, Tenn.).

This comparative formulation is coated on base paper with a coat weight of 15 gsm, and calendering condition for this formulation is the same as in Example 1. The sample was also printed on a HP 8060 MFP with Edgeline technology. Among all the formulation, this one gives the best image quality and high-lighter testing results. However, the KOD of the image was a little lower (1.86) than samples with the exemplary formulations (2.2). Also the sheet gloss was much lower for this comparative example, only 36% at 70°. The major disadvantage of this formulation is its cost.

COMPARATIVE EXAMPLE B (INKJET MEDIA)

Top coating formulation:
Orisil™ 200: 100 parts

Tego Wet™ 510: 0.2 parts
Celvol™ 350: 8 parts
Glascol™ F207: 2 parts
$CaCl_2$: 0.5 parts
Ultralube™ E846:15 parts
Base coating formulation:
Opacarb™ A40: 60 parts
Ansilex™ 93: 40 parts
Tego Wet™ 510: 0.7 parts
Litex™ 7110: 11 parts
Mowiol™ 20-98: 0.5 parts
Dow DPP™ 3720: 5 parts Celvol™ 350 (Celanese Corporation, Dallas, Tex.) is a standard grade polyvinyl alcohol having a viscosity of 62-72. GLASCOL™ F207 (Ciba Corporation, Newport, Del.) is an aqueous solution of poly(dimethyl diallylammonium chloride) homopolymer, which is a low molecular weight, high charge density cationic polyelectrolyte. Ultralube™ E846 (Keim-Additec, Kirchberg, Germany) is a water-based wax emulsion containing non-ionic high density polyethylene. Litex™ 7110 (Polymer-Latex, Marl, Germany) is an aqueous, anionic carboxylated styrene/butadiene copolymer dispersion. Dow DPP™ 3720 (Dow Chemical, Dalton, Ga.) is an aqueous 50% plastic pigment slurry of styrene/butadiene emulsion copolymer.

In order to lower inkjet media cost, this modification of the above-described comparative formulation was prepared. The image layer (top coating formulation, coat weight of 5 gsm) was coated on a base coat (base coating formulation, coat weight of 20 gsm). The samples gave good gamut and KOD. However, there were many print mottles in image area. The overall image quality was unacceptable. Also the high-lighter testing result was not good, as indicated in Table 1.

COMPARATIVE EXAMPLE C (OFFSET MEDIA)

Opacarb™A40: 60 parts
Ansilex™ 93: 40 parts
Tego Wet™ 510: 0.7 parts
Litex™ 7110: 11 parts
Mowiol™ 20-98: 0.5 parts
Dow DPP™ 3720: 5 parts This formulation contains only generally low-cost pigments, like PCC and clays, without any relatively expensive materials like silica particles. However, the image quality resulting from this formulation was worse than all other samples, as indicated in Table 1, by lower gamut, and this sample also included the most print mottles of all the samples reported in Table 1. This sample also performed very poorly in high-lighter testing.

The combination of three different kinds of pigments, as demonstrated by Examples 1 and 2, provides a coating layer with fast liquid penetration, large capacity for receiving and retaining liquid (i.e., ink), and even ink absorption across the inkjet media. As shown in Table 1, both embodiments show high sheet gloss. When printed with pigment-based inks embodiments, they provide good image quality, comparable to a low cost inkjet coated media (Comparative Example B) or better than a inkjet coated media based on silica pigment (Comparative Example A), such as color gamut and KOD. Visual observation finds no or very little print mottle, no obvious bleeding and coalescence. Compared to the sample of offset coated media (Comparative C), both embodiments significantly improved image quality (e.g., color gamut, KOD, print mottles, bleeding, and coalescence), and also durability properties, especially high-lighter smear at 24 hours after printing. The disclosed combinations of three different kinds of pigments offer a different and potentially better way to address the requirements of new high-speed printers using pigment-based inks, such as image quality, durability, and low cost.

Inkjet Printing Method

To reduce the risk of print mottling of the coated media when used in an inkjet printing system, even absorption rate of the inkjet ink across the inkjet media is required. At the same time, inkjet printing, especially high-speed inkjet printing, also requires high absorption rate and large absorption capacity for the intended ink. An above-described print medium is used with any suitable inkjet printer, and any pigment-based inkjet ink that is ordinarily used for inkjet printing. One such printer is HP 8060 MFP™ with Edgeline™ technology (Hewlett-Packard Corporation), which can print up to 60 pages per minute.

Figure 3:
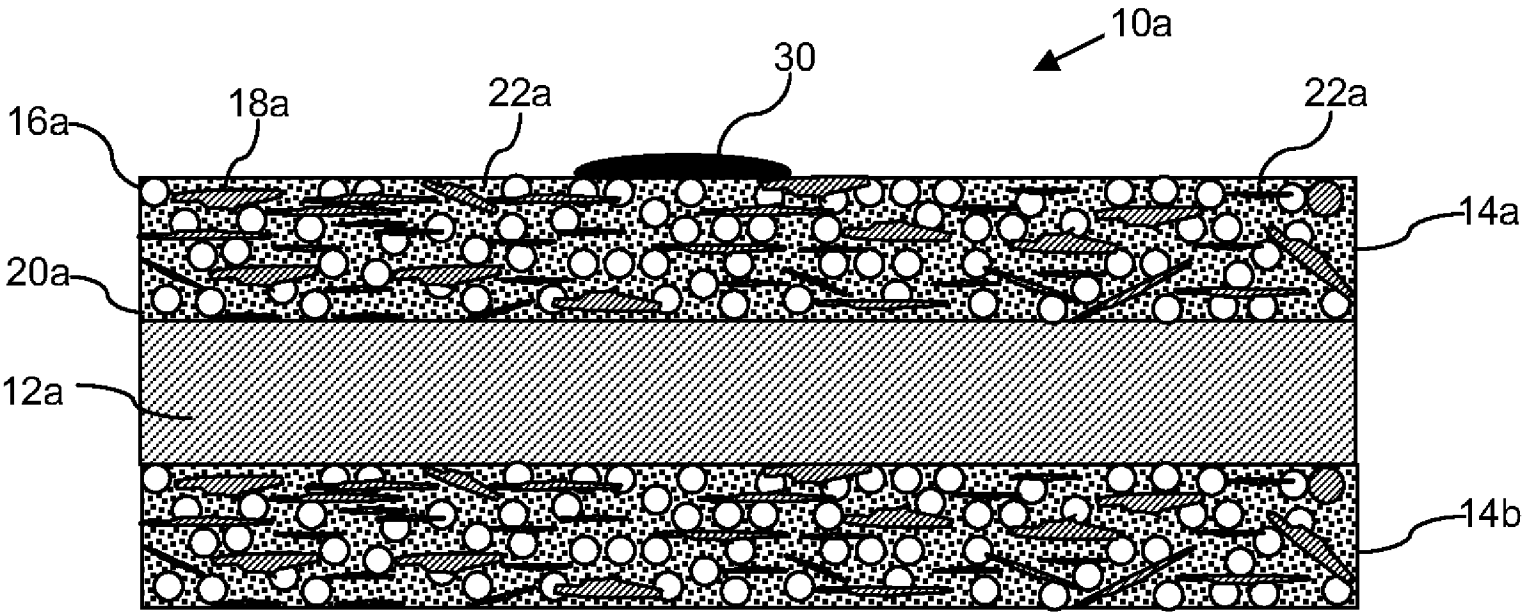
FIG. 3 is a schematic illustration of a coated print medium when used for receiving an inkjet printed image, in accordance with still another embodiment of the invention.

Referring to FIG. 3, a print medium 10*a* like that of FIG. 2 is printed with a pigmented ink, a deposited ink droplet 30 is quickly absorbed into the voids 22*a*, the third pigment particles 20*a*, and into the first and second pigment particles 16*a* and 18*a*. This combination of three different kinds of pigments provides a coating layer with fast liquid penetration, large capacity for receiving and retaining liquid (i.e., ink), and even ink absorption across the inkjet media. When printed with pigment-based inks, embodiments of the print media provide good image quality with no or very little print mottle, and with improved durability properties, especially high-lighter smear and rubbing performance. Embodiments of the inkjet specialty media described herein now make the new high-speed printers feasible for most applications.

The above discussion is meant to be illustrative of the principles and various embodiments of the present invention. Numerous variations and modifications will become apparent to those skilled in the art once the above disclosure is fully appreciated. It is intended that the following claims be interpreted to embrace all such variations and modifications.

TABLE 1

Test Results for the Coating Formulation Examples

| Samples | Sheet gloss (75°) | Gamut | KOD | High-lighter smear (mOD), 1 pass, 5 min. | High-lighter smear (mOD), 2 passes, 5 min. | High-lighter smear (mOD), 1 pass, 24 hrs. | High-lighter smear (mOD), 2 passes, 24 hrs. |
|---|---|---|---|---|---|---|---|
| Example 1 | 70 | 387K | 2.2 | 90 | 360 | 60 | 110 |
| Example 2 | 65 | 427K | 2.32 | 400 | 620 | 40 | 270 |
| Comparative A | 36 | 386K | 1.86 | 50 | 150 | 20 | 60 |
| Comparative B | 59 | 421K | 2.07 | 180 | 430 | 120 | 430 |
| Comparative C | 45 | 352K | 2.16 | 450 | 580 | 180 | 450 |

What is claimed is:

1. A print medium, comprising:

a base paper comprising a first side and a reverse side; and a coating layer disposed on at least said first side, said coating layer comprising a mixture comprising about 10 to about 90 weight percent of a first pigment comprising precipitated calcium carbonate particles, about 5 to about 60 weight percent of a second pigment comprising particles of a liquid absorptive material having a larger size than said first pigment particles and a different shape than that of said first pigment particles, and about 1 to about 50 weight percent of a third pigment comprising particles of a liquid absorptive high surface area material having a surface area of at least 50 $m^2$/gram, wherein said weight percentages are by combined weight of the first, second and third pigments.

2. The print medium of claim 1, wherein said first pigment makes up about 25 to about 75 weight percent of said coating layer.

3. The print medium of claim 1, wherein said first pigment makes up about 40 to about 65 weight percent of said coating layer.

4. The print medium of claim 1, wherein said second pigment makes up about 5 to about 40 weight percent of said coating layer.

5. The print medium of claim 1, wherein said second pigment makes up about 10 to about 35 weight percent of said coating layer.

6. The print medium of claim 1, wherein said third pigment makes up about 5 to about 35 weight percent of said coating layer.

7. The print medium of claim 1, wherein said third pigment makes up about 10 to about 25 weight percent of said coating layer.

8. The print medium of claim 1, wherein said first pigment comprises precipitated calcium carbonate particles less than 1 micron in their largest dimensions.

9. The print medium of claim 8, wherein said first pigment comprises precipitated calcium carbonate particles no more than about 400 nm in their longest dimensions.

10. The print medium of claim 1, wherein said second pigment particles have an aspect ratio of dimension to thickness in the range of about 5 to about 100.

11. The print medium of claim 10, wherein said second pigment particles comprise platey clay.

12. The print medium of claim 10, wherein said second pigment particles have a dimension up to 10 microns.

13. The print medium of claim 1, wherein said second pigment comprises ground calcium carbonate.

14. The print medium of claim 1, wherein said coating layer further comprises a binder.

15. The print medium of claim 1, wherein said coating layer further comprises liquid-receptive voids between said first, second and third pigment particles.

16. The print medium of claim 1, wherein said third pigment particles are porous.

17. A method of enhancing image quality and permanence of an inkjet printed image, comprising:

obtaining the print medium of claim 1;

inkjetting a pigmented ink onto the coating layer of said print medium, to form a printed image; and drying the printed image, to provide a printed medium with enhanced image quality and enhanced image permanence.

18. The print medium of claim 1, wherein said third pigment is selected from the group consisting of fumed silica, silica gel, colloidal silica, zeolite and alumina.

* * * * *